United States Patent [19]

Choate

[11] 4,422,802

[45] Dec. 27, 1983

[54] LEG LOAD DISTRIBUTION AND LOCKING ARRANGEMENT FOR JACK-UP TYPE MOBILE OFFSHORE PLATFORM

[75] Inventor: Kenneth P. Choate, Houston, Tex.

[73] Assignee: Robin Shipyard (PTE.) Ltd., Singapore, Singapore

[21] Appl. No.: 251,775

[22] Filed: Apr. 7, 1981

[51] Int. Cl.[3] ..... E02B 17/00

[52] U.S. Cl. ..... 405/198; 405/196; 405/203

[58] Field of Search ..... 405/195–200; 175/5–7; 254/105, 106, 107, 112

[56] References Cited

U.S. PATENT DOCUMENTS

| | | | |
|---|---|---|---|
| 2,839,164 | 6/1958 | Roussel | 405/199 X |
| 3,183,676 | 5/1965 | Le Tourneau | 405/196 |
| 3,565,400 | 2/1971 | Yamura | 254/106 |
| 3,828,561 | 8/1974 | Moore et al. | 405/197 |

*Primary Examiner*—Dennis L. Taylor
*Attorney, Agent, or Firm*—Jack W. Hayden

[57] ABSTRACT

A plurality of vertically extending guide means is carried by the structure of a jack-up type mobile offshore platform. The guide means is spaced about each of the vertically extending legs which engage the floor of a water-covered area and enable the hull, forming part of the structure, to be elevated and supported in position above the water in the water-covered area. A first pair of wedges forms a first wedge means that is movable vertically in each of the guide means, and a second pair of wedges forms a second wedge means that is spaced vertically in each of the guide means relative to the first wedge means. The first and second wedge means are also movable vertically in the guide means. Means interconnect the pair of wedges which form each the first and second wedge means so that one of the wedges of each pair may be moved to engage a vertical leg chord and thereby lock the legs to the structure and distribute loads and more particularly horizontal loads applied to the structure at joints of the vertically extending leg chords, that is, at the intersection of the vertical leg chords with the respective laterally extending braces between the leg chords.

24 Claims, 14 Drawing Figures fig.1B
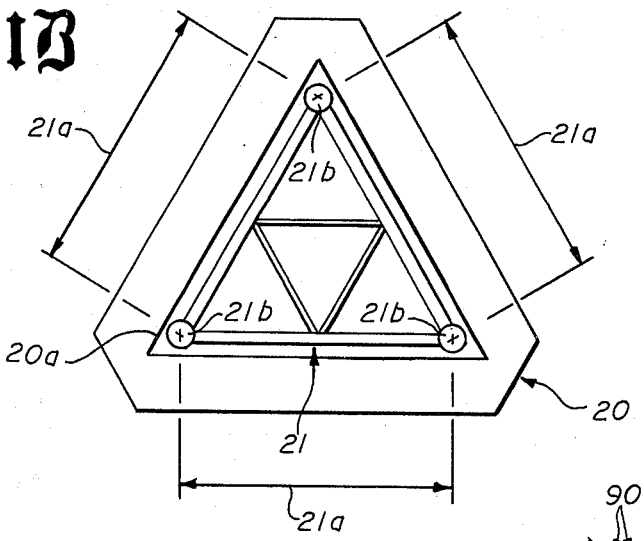
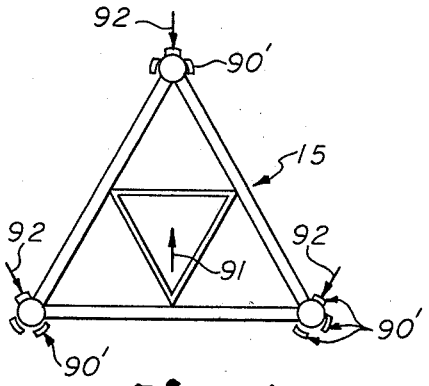
fig.2
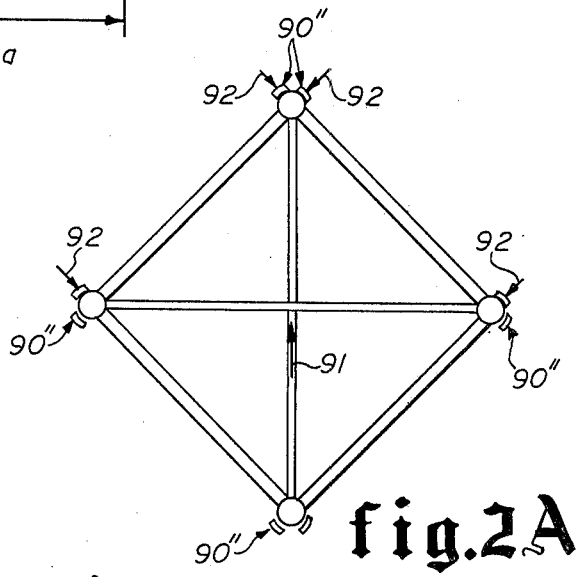
fig.2A
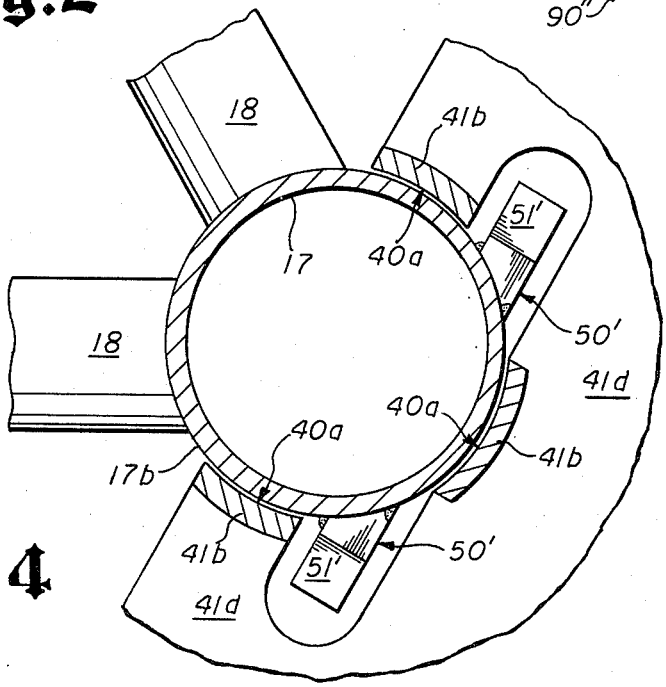
fig.4

LEG LOAD DISTRIBUTION AND LOCKING ARRANGEMENT FOR JACK-UP TYPE MOBILE OFFSHORE PLATFORM

SUMMARY OF THE INVENTION

Generally speaking, the legs of most independent leg jack-up platforms are lattice or truss construction because the truss usually provides a more efficient construction. Thus, the legs are formed by a plurality of vertical leg chords interconnected by lateral bracing extending therebetween and connected to the leg chords. Such construction usually entails a minimum weight of legs which may be attributed to the efficiency of truss construction in general, and when the truss is subjected to lateral forces or loads from storm waves, such forces or loads are generally less for a truss than any other leg configuration. At present, the method by which the forces are transmitted from the legs to the platforms when jacked-up or elevated in a water-covered area is critical to the design of the legs. Heretofore, most designs use guides in the platform which not only guide the legs as they are jacked through the platform to seat on the bottom in the water-covered area, but which also guide the platform or hull as it is jacked to an elevated position above the water in the water-covered area. In addition, the leg chords and legs and guides of the prior art also are intended to absorb or take the forces normally applied to the structure, as well as those induced or applied thereto by a storm.

Jack-up type mobile offshore platforms presently employed are generally provided with two levels of jacking guides adjacent each leg. The upper level of jacking guides is generally located above the rig jacks or mechanism used to lower the legs onto the subsea surface and thereafter elevate the structure, and the other level of jacking guides is vertically aligned with the upper level of jacking guides but is located generally near the bottom of the hull forming a part of the offshore structure. As previously noted, present jack-up type structures rely upon the jacking guides to absorb the forces or loads from the leg chords during normal operations of the platform, as well as loads that arise when the structure is subjected to a storm.

One problem that arises from such prior art construction is that there must be sufficient clearance between the jacking guides and the leg chords (vertical members of the truss legs) to assure that the legs will be free to move vertically for the full length necessary in the vertical direction to both lower the legs onto the submerged surface of the water, as well as accommodating elevation of the hull above the water. If at any vertical position of the legs relative to the jacking guides there is insufficient clearance, the legs may bind in the guides as they pass therethrough. This can prevent further relative movement between the legs and jacking guides and may cause damage to the structure or to the legs. The clearance provided between the jacking guides and the leg chords must be kept to a minimum to insure adequate bearing or surface contact between the vertically extending leg chords and the guides when the leg chords are in their final relationship relative to the hull. Improper, or large clearance between the guides and vertically extending leg chords may result in increased local stresses in the leg chords due to uneven contact between the leg chords and the guides, or due to no contact between some of the leg chords and some of the guides while improper contact between the leg chords and other of the guides. In order to provide acceptable clearance for minimum local stresses, attempts have been made to fabricate the legs to tolerances which are very difficult to maintain. It can be appreciated that the legs of such structures are relatively large and the cost of manufacturing or fabricating such legs in an attempt to maintain the desired tolerances is increased considerably. Also, the roundness and diameter of the leg chords are other critical dimensions which must be maintained to try to provide the proper tolerances in the resulting structure. Legs which include nontubular chords have yet further dimensions which become critical for proper clearance between the jacking guide and the chords of the legs.

When an independent leg platform (legs not connected to a mat at the bottom of the legs) is jacked-up in operating position, the vertical extent of each leg is usually different with respect to a horizontal plane. This may be caused an unlevel surface in the water-covered area, or differences in penetration of the water-covered surface by the legs. Where the legs of the mobile jack-up type structure are formed of trusses, it is very desirable to have the reaction from the jacking guide react to the leg chords at the leg joint, that is the intersection points of the truss members. If the reaction is located between joints of a leg chord, undesirable bending stresses are induced into the leg chord. To sustain the undesirable bending stresses, as well as accommodate axial stresses and minimal secondary bending stresses, leg designs result which incorporate very heavy leg chords. This increases the cost as well as increasing the leg weight, which in turn presents stability problems for floating conditions of the platform as it is moved from location to location. Also, if the legs of the prior art are not of the substantially same vertical extent, the hull or platform cannot be elevated to final position above the water-covered area so that the reaction point is at a joint in each leg. In such situation, fixed guides must be assumed by designers to react in between leg joints. However, even long guides which overlap two leg joints cannot necessarily be assumed to react at the joint because of the guide clearances employed in the prior art. Legs or prior art construction will generally pivot in proportion to the guide clearances and space between the upper and lower guides resulting in an angle other than 90 degrees between the legs and horizontal plane of the hull. This may cause the reaction points to be near the top of the upper guides that are above the jacking arrangement and at the bottom of the lower guides that are in the hull. This may result in minimal vertical contact between the leg chords and adjacent jacking guides. For circular chords and their corresponding guides, full lateral contact generally cannot be made because the guides have a slightly larger radius than the chords in order to provide the necessary clearance for jacking. Usually the chord and guide contact is made worse by the fact that the chords and the guides do not have a common center since the chord must shift laterally in order to contact the guide.

When fixed guides are used, as is the case with prior art constructions, to take the reaction force from the legs, the distribution of the loads among the leg chords may, due to construction tolerances between the legs and the jacking guides, be applied unevenly among all of the legs or even concentrated on a single leg chord.

Also, it is highly desirable that the rig-jacking system be operable without delay in an emergency situation.

For example, if there is a sinking of one or more of the legs into the sea bed while operating, or during operations, it is very important to be able to jack-up the hull to a level position as quickly as possible to inhibit damage to the legs or to reduce the likelihood of capsizing the entire structure. This invention does not restrict this capability. Once engaged, the wedge means simulate guides with practically zero clearance with the legs. However, the emergency jacking which may be necessary is for relatively short distances and the tolerances for the critical dimensions of the legs in short distances are insignificantly small. Once this emergency jacking is complete it may be necessary to reposition the wedge means in order that they will be in line with a joint in the leg chords.

It is an object of the present invention to overcome the foregoing and other problems encountered with present jack-up type mobile offshore platform structures.

One of the objects of the present invention is to provide some structure other than the jacking guides to distribute lateral forces between the hull and the legs of a mobile jack-up type offshore platform.

Another object of the present invention is to eliminate the use of the jacking guides of a mobile jack-up type offshore platform as the load bearing member to take the storm induced forces or loads between the legs and the platform.

Yet a further object of the present invention is to provide an arrangement for more equally distributing the load between all of the legs of a jack-up type mobile offshore platform.

Still another object of the present invention is to provide an arrangement to assure that the reaction point in each leg of a jack-up type mobile offshore platform is maintained at a joint in each of the legs.

Still another object of the present invention is to eliminate the necessity of maintaining close tolerances between the leg chords and the fixed jacking guides in an endeavor to properly distribute the load among the leg chords.

Yet a further object of the present invention is to provide a force and load bearing arrangement for an offshore structure which does not delay or interfere with the operation of the structure jacking system in an emergency situation.

An object of the present invention is to provide in a jack-up mobile offshore structure an arrangement wherein a hull provides a working area platform with openings therethrough for receiving vertically extending legs, and wherein a cooperating jacking arrangement between the hull and legs enables the legs to be lowered onto a subsea surface so that the hull may then be moved on the legs to an elevated position above the water for conducting drilling or other operations.

An object of the present invention is to provide in a jack-up mobile offshore structure wherein a hull provides a working area platform with openings therethrough for receiving vertically extending legs, and wherein a cooperating jacking arrangement between the hull and legs enables the legs to be lowered onto a subsea surface so that the hull may then be moved on the legs to an elevated position above the water for conducting drilling operations, an arrangement including a plurality of vertically extending guide means carried by the hull spaced about each of the legs; a first pair of wedges forming a first wedge means; a second pair of wedges forming a second wedge means spaced vertically in each of said guide means relative to said first wedge means, said first and second wedge means independently movable vertically in each of the guide means; and means interconnecting the pair of wedges which form each of the wedge means whereby one of the wedges of each pair of wedge means may be moved to engage a leg chord and thereby secure the legs to the structure so that lateral forces from the legs are distributed to the structure.

An object of the present invention is to provide in a jack-up mobile offshore structure wherein a hull provides a working area platform with openings therethrough for receiving vertically extending legs having vertical chords, and wherein a cooperating jacking arrangement between the hull and legs enables the legs to be lowered onto a subsea surface so that the hull may then be moved on the legs to an elevated position above the water for conducting drilling or other operations, an arrangement to secure the structure and legs together so that the reaction forces are more evenly distributed to the vertical chords of each leg.

Other objects and advantages of the present invention will become more readily apparent from a consideration of the following description and drawings.

BRIEF DESCRIPTION OF THE DRAWINGS

FIG. 1B is a diagrammatic plan view of one vertical leg of a mobile offshore structure in an opening in an offshore platform and diagrammatically illustrates one of the prior art problems which the present invention overcomes;

FIG. 2 is a schematic representation diagrammatically representing the force and reaction forces in a triangular leg configuration as may be employed in the present invention;

FIG. 2A is a schematic representation diagrammatically illustrating the force and reaction forces when a rectangular truss leg arrangement has incorporated therein the present invention;

FIG. 4 is a diagrammatic sectional view on the line 4—4 of FIG. 3 showing the relative position of the jacking guide and the vertical leg chord of a truss leg as exemplified by the present invention;

DESCRIPTION OF PREFERRED EMBODIMENT

Figure 1:
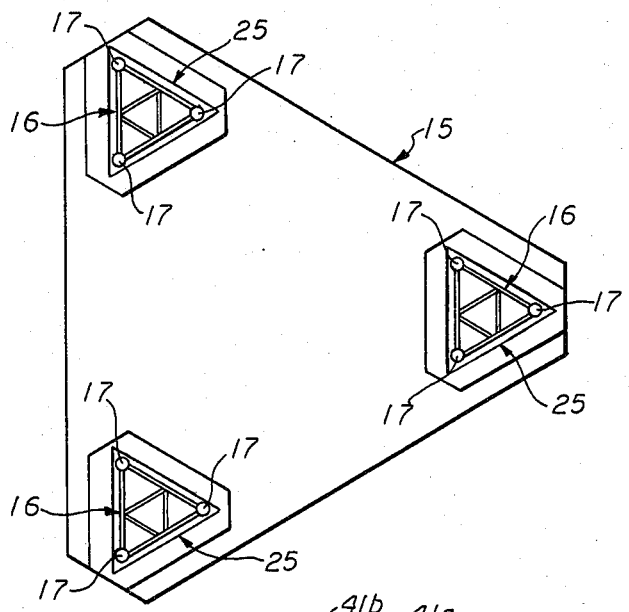
FIG. 1 is a schematic plan view of one form of truss leg jack-up platform.
Figure 1A:
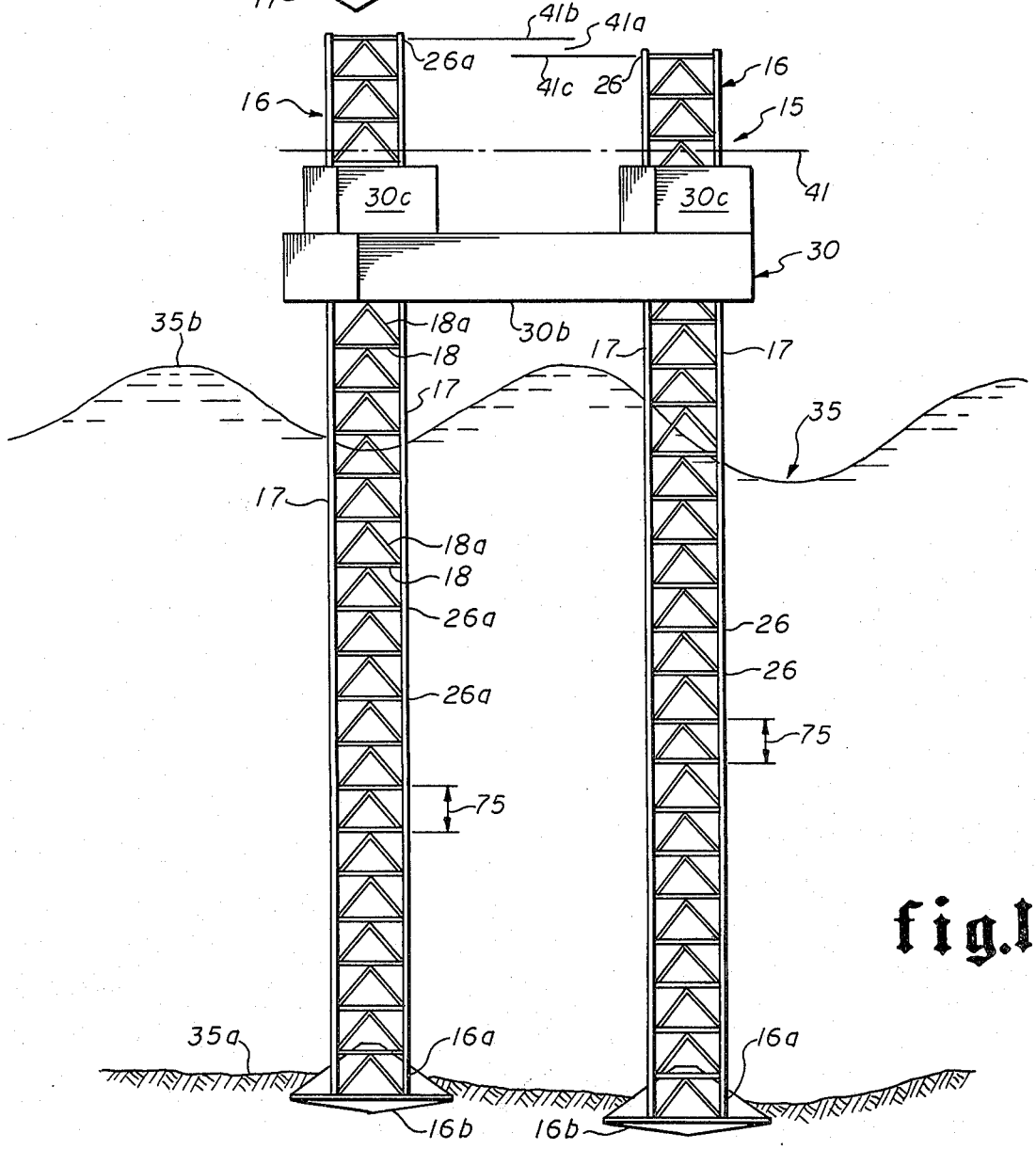
FIG. 1A is a schematic elevational view of one form of jack-up platform on location illustrating a difference in vertical position of the legs.

Attention is first directed to FIG. 1 of the drawings wherein a jack-up type mobile offshore platform is shown in schematic plan view and represented by the numeral 15. In FIG. 1A a schematic elevational view of a mobile jack-up type offshore platform is again referred to generally by the numeral 15 and is illustrated as including legs referred to generally at 16 which extend through openings referred to generally at 25 in FIG. 1 through the hull referred to generally at 30. The hull 30 provides a working area or platform for receiving and supporting various drilling or other apparatus and equipment used in conducting well drilling or any other operations in a water-covered area referred to generally at 35. The hull also provides living quarters for the operating crew. None of the details of the hull is illustrated as the type of drilling or other operations equipment, as well as the arrangement of the living quarters for the personnel will vary in any suitable manner as may be determined by those skilled in the art, and forms no part of the present invention.

It will be noted that the legs 16 are illustrated as being triangular in cross section, with each leg 16 including three vertical, cylindrical leg chords 17, which are interconnected by horizontal and laterally extending brace members 18, **18*a* as schematically illustrated in FIGS. 1 and 1A to form a truss. It can be understood that the configuration of the legs 16 need not be limited to triangular, and the vertical leg chords need not be cylindrical, but may assume other configurations well known to those skilled in the art. Thus, as illustrated in FIG. 1 of the drawings, the triangular-shaped legs 16 with cylindrical leg chords 17 extend through the triangular-shaped openings 25 in the hull 30. When the hull 30 is under tow or being moved from one location to another in the water-covered area 35, the legs 16 are elevated so that their lower ends, represented at 16*a*, terminate adjacent or near the bottom 30*b* of the hull 30**.

When the hull 30 has reached the desired location in a water-covered area 35 at which it is desired to conduct drilling or any other operations, suitable jack means, the construction of which is well known to those skilled in the art, are provided in the jack housing **30*c* on the hull 30, there being jack means for each leg chord 17 of the triangular legs 16 of structure 15. The jack means (not shown) are actuated so as to stepwise lower the legs 16 through their respective openings 25 in the hull 30 so as to seat the lower end 16*a* of each leg in the bottom 35*a*, as illustrated in FIG. 1A. Various jack means are well known to those skilled in the art, the most common of which comprises gear racks on leg chords 17 engaged with gear means supported in a well known manner in jack housing 30*c***. The present invention will be described as it applies to a gear and rack jacking arrangement, but it may be employed with other types of jacking arrangements, and the present explanation is by way of example only, and is not intended to be limited as described.

As schematically represented in FIG. 1A of the drawings, the legs 16 are not connected to a mat at the bottom **16*a* of the legs and they are independent. That is, each leg 16 is independent of the other and may be provided with a suitable footing represented at 16*b*. The vertical position of the independent legs 16 may be different with respect to a horizontal plane represented by the line 41 in FIG. 1A. The difference in vertical position of the legs 16 is further illustrated by the space 41*a* between the lines 41*b*, 41*c* with 41*b* representing the vertical position of a joint in the leg chords 17 in the leg 16 on the left in FIG. 1A, with the line 41*c* representing the vertical position of a joint in the leg chords 17 in the leg 16 on the right hand side of FIG. 1A. The difference in the vertical position of the joints of the legs 16, as represented by the planes 41*b* and 41*c* through legs 16 as shown in FIG. 1A, may be caused by unlevel seabeds, or by differences in penetration of the seabed 35*a* by each leg 16. The problem created by the difference in vertical positions of the independent legs 16** as described above, and the manner in which the present invention overcomes such problem will be described in greater detail hereinafter.

After each leg 16 has been positioned on or in the seabed **35*a*, the jack mechanism in the jack housing 30*c* of each leg chord 17 is then actuated so as to elevate the hull 30 above the level 35*b* of the water-covered area 35 so that the bottom 30*b* of the hull 30** will clear any wave action that may be normally encountered.

As previously noted, the legs 16 are illustrated as being of lattice or truss construction which is recognized by many skilled in the art as usually being the most efficient construction for use in an independent leg offshore mobile jack-up platform, in general, and forces from storm waves may be less for a truss than other leg configurations. In prior art devices, jacking guides are provided in the platform which not only guide the legs as the legs are initially lowered onto the seabed **35*a* and the hull thereafter jacked to an elevated position on the leg 16, but such jacking guides in the prior art also transmit the forces induced by storm loading between the legs and the platform. Heretofore, there have been normally employed two levels of jacking guides for each leg 16** of a mobile jack-up type offshore hull or platform. One level of guides is located above the rig jacks and the other level of jacking guides is located near the bottom of the platform.

It can be appreciated that the leg chords, or vertical members 17 of the truss legs 16 must have sufficient clearance relative to the jacking guides to assure that the leg chords 17 will be free to move vertically for the full length of travel in the vertical direction. They are moved to initially position them on the seabed **35*a* and to thereafter accommodate elevation of the hull 30 as described with regard to FIG. 1A. If at any vertical position of the leg chords 17** in the jacking guide there is insufficient clearance, the legs of the prior art structure will bind in the jacking guide as they pass therethrough. This will cause locking of the legs to the jacking guide so as to prevent further relative movement between the legs and the jacking guide, or it may result in damage to the legs or to the jacking guide.

Also, the clearance provided between the jacking guide and leg arrangement of the prior art had to be kept to a minimum to insure adequate bearing contact between the leg chord, such as those represented at 17 in FIG. 1A of the present invention, and the jacking guide (not shown). If there is a large clearance between the vertical members or chord 17 of the legs 16 of drilling platforms of the prior art and their respective jacking guides, increased local stresses in the leg chords may result since the legs of the prior art arrangement may cause the legs and jacking guide to engage improperly and cause contact loading over a relatively small area of the jacking guides, thus increasing the loading per unit area.

In order to provide acceptable clearance for minimum local stresses between the legs and jacking guides of prior art arrangements, the legs must be manufactured or fabricated to tolerances which are very difficult to maintain. For example, attention is directed to FIG. 1B wherein a plan view of one leg opening 20*a* in a platform 20 of the prior art is illustrated with a leg 21, similar in structural details to legs 16 of FIGS. 1 and 1A is illustrated. One of the major critical dimensions which should be maintained with prior art devices in order to provide acceptable clearance for minimal local stresses as above mentioned is the dimension between the centers of the leg chords 21*b*, such distance being represented at 21*a* in FIG. 1B. Since the legs 21 are of substantial size, the difficulty in trying to maintain the distance 21*a* between the longitudinal axis of the leg chords 21*b* within close tolerances can be appreciated. Also, the diameter and roundness of the vertical chord members of each of the legs 21 of prior art arrangements are other critical dimensions to be considered for maintaining proper tolerances between the legs 21 and the jacking guide arrangement of the prior art devices. Where legs with non-tubular vertical members or chords are employed in prior art devices, still other dimensions become critical to maintain the proper relationship and clearance between the jacking guide and leg arrangement of prior art structures.

In addition, when an independent leg platform such as that illustrated by FIGS. 1 and 1A is positioned in a water-covered area in operating position as represented in FIG. 1A, the vertical position of each leg 16 may be different as previously noted; this therefore causes the leg joints, which are the intersection points of the vertical members or chords 17 with their respective lateral braces 18 and 18*a*, to be at different vertical positions. For example, in FIG. 1A, the joints in one leg 16 may be represented by the numeral 26 and the joints in the other leg 16 shown in FIG. 1*a* are represented at 26*a*. As previously noted, FIG. 1A illustrates a vertical offset between the joints 26 and 26*a* of the legs 16 shown in FIG. 1A by the dimension represented at 41*a*.

It would have been advantageous to have reaction forces from the jacking guides of prior art devices react at the leg joints, that is, at the intersection points of the vertical members and the lateral bracing members which form the truss arrangement of the legs.

As previously noted, if the reaction location is between joints, that is, if the jacking guides of the prior art transmit reaction forces between joints of legs rather than the leg joints, bending stresses are induced in the leg chords that are undesirable. In order to withstand these bending stresses which combine with the axial stresses that would be in the chords regardless of the location of the application point, some prior art devices employ very hefty and heavy leg chords. This is disadvantageous in that the heavy leg chords are costly and the extra leg weight presents stability problems for floating conditions of the offshore platform.

When the joints of the legs of prior art devices are not in the same vertical position, it is difficult, if not impossible, to elevate the platform such that the reaction point may be predetermined, or located at a joint in each leg of the prior art. Thus, in prior art arrangements fixed guides must be assumed by designers to react in between leg joints.

Prior art jack-up type mobile offshore platforms which have endeavored to employ some type of chocking arrangement as a means to transmit loads from the leg to the hull may create other problems. For example, if there is a sinking of one or more legs into the seabed while operating, it is very important to be able to jack the platform back to a level position quickly to prevent damage to the legs or capsizing of the structure. The chocking arrangements of the prior art may hinder jacking the platform up to reposition it at a level, horizontal position in a minimum amount of time.

The present invention overcomes the foregoing problems since it is not necessary to disengage the wedge means, or chocking arrangement, before jacking to relevel the platform begins. Also, the present invention employs adjustable means which may be manipulated to horizontally lock or secure each chord of each leg at any joint to the platform after the platform and legs have been positioned at a desired elevation in a water-covered area. More particularly, the vertical extent of the adjustable means in relation to the vertical extent between each joint of the leg chords is such that the platform may be jacked to an elevation so that the wedge means then may be manipulated to engage each vertical leg chord of each leg at a joint. Further, such arrangement distributes the leg to platform horizontal reactions among the leg chords so as to inhibit application of such reactions at one leg chord alone. The present invention also assures that the horizontal reaction distribution from the legs to the platform occurs at a leg joint rather than between the joints and also enables the rig jacking system to be operable without delay in emergency situation.

Figure 3:
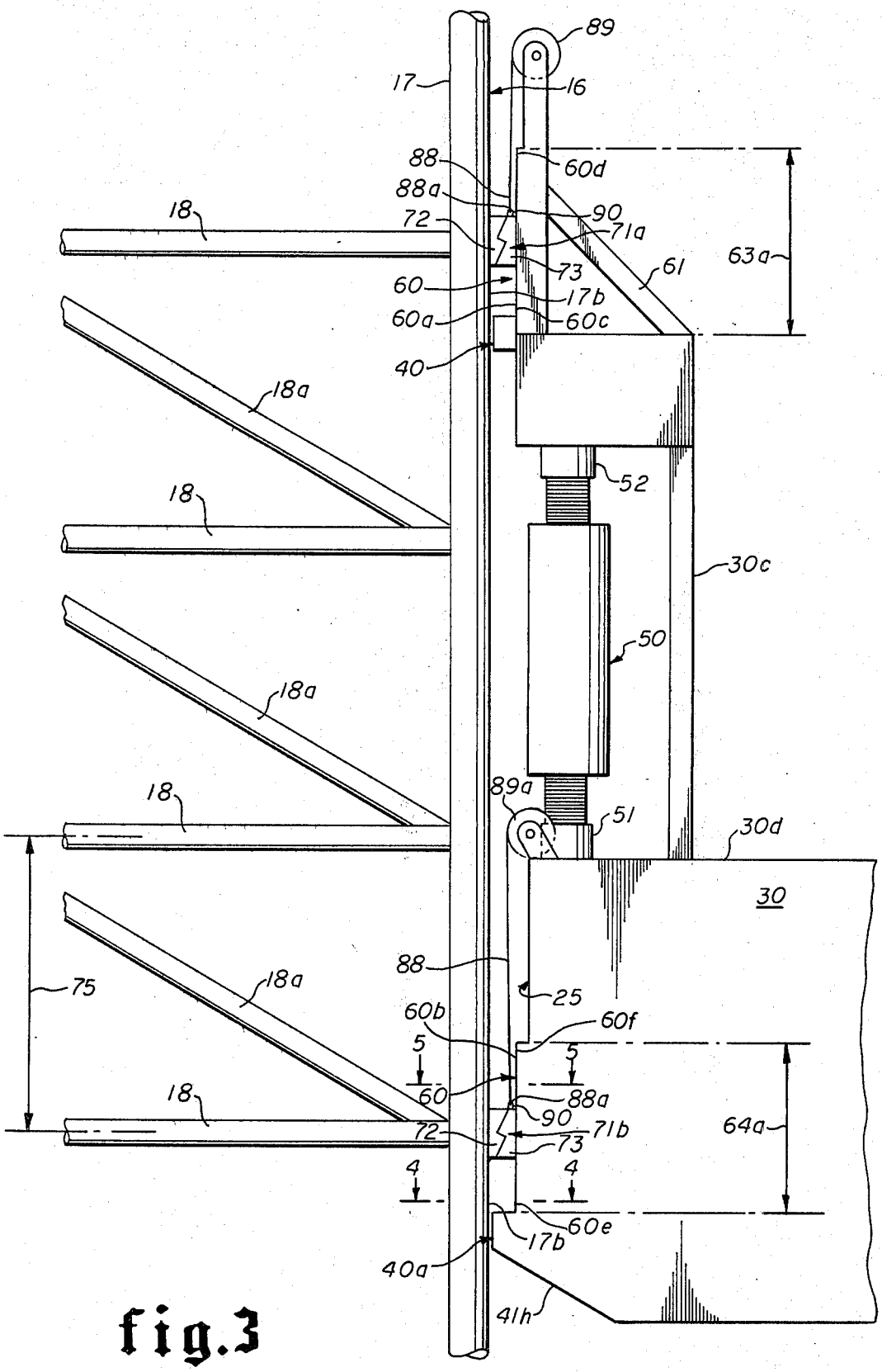
FIG. 3 is a schematic representation illustrating a single leg chord of a leg and one relative position of the jacking guides, the jacking means, the hull, wedge guide means, and wedge means employed in the present invention.

Attention is directed to FIG. 3 of the drawings wherein a vertical member or chord 17 of a truss leg 16 construction is diagrammatically illustrated in greater detail. It can be appreciated that only one leg chord 17 is shown and only one set of upper and lower wedge guide means are shown. Also, only one pair of upper and lower wedge means are shown. However, each vertical member or leg chord 17 of a platform jack-up leg 16 will usually be provided with more than one upper and lower wedge guide means, and a corresponding upper and lower wedge means for each of the wedge guide means of the same arrangement and construction as described hereinafter.

The hull is again illustrated at 30, and the hole or opening 25 therethrough for receiving the leg referred to generally by 16 is illustrated. A jacking guide for the leg chord 17 shown in FIG. 3 is represented generally at 40, such jacking guide 40 being shown as positioned above the jack mechanism represented generally by the numeral 50, which jacking mechanism is illustrated as being supported at its lower end 51 on the platform or deck area 30*d* of the hull 30. The construction and arrangement of the jack mechanism 50 are well known to those skilled in the art and the specific details are therefore believed unnecessary to an understanding of the present invention. The jack housing 30*c* may receive and support the upper portion 52 of the jack mechanism 50 as illustrated in the drawing.

Additional jacking guide means 40*a*, similar to jacking guide means 40, is provided adjacent the lower portion of the hull 30, and one embodiment or relationship between the jacking guide means and one leg chord 17 of the present invention is better illustrated in FIG. 4 of the drawings.

There, a single-leg chord 17 is illustrated which is one of the vertical members forming a leg 16 as shown described with regard to FIGS. 1, 1A and FIG. 4 of the drawings. Also, the horizontal bracing 18 extending between leg chords 17 is shown as being connected to the vertical leg chord 17 shown in FIG. 4.

Where the leg 16 is triangular and the chords 17 are cylindrical, the lower jacking guide means 40*a* is represented in FIG. 4. For this example, there are three of such jacking guides 40*a* for each leg chord 17. The lower jacking guide means includes support member 41*d* which is secured to the hull 30 and which extends circumferentially in relation to each leg chord 17 so as to project laterally into the hull opening 25 as illustrated in FIGS. 3 and 4. The inner edge of member 41*d* is provided with circumferentially spaced, arcuate members or portions 41*b* which form the jacking guides 40*a*, as illustrated which generally conform with the periphery 17*b* of the tubular member 17 forming the vertical leg chord 17.

The arcuate jacking guides 40*a* also extend vertically as represented in FIG. 3 to form a guide surface and their lower end may be supported by circumferentialy extending member 41*h* that is part of hull 30 which surrounds the lower end of each opening 25. The vertically extending, spaced arcuate jacking guides 40*a* are also spaced circumferentially in plan for this example, from the periphery 17*b* of the tubular member 17*a* forming leg chords 17 to provide clearance between the leg chords 17 of each leg 16 and the guide means 40*a* defined by the support members 41*d*, and plan view spaced arcuate portions 41*b*.

As illustrated in FIG. 3, upper jacking guide means 40 is supported on jack housing 30*c* and projects laterally inwardly relative to openings 25 in jack housing 30*c*. Circumferentially extending and circumferentially spaced guide surfaces 41*b* are provided by such guide means. The inner curved guide portions 41*b* of upper jacking guide means 40 are in the same vertical plane as the curved portions 41*b* of the lower jacking guide means 40*a*. The upper jacking guide means 40 and lower jacking guide means 40*a* are spaced vertically.

Where other leg configurations and other configurations of the leg chords 17 are employed, the shape and arrangement of the jacking guide means will be of a form to accomplish the desired results.

In addition, gear racks 50′ having teeth 51′ are depicted as being mounted by means well known in the art to the leg chords 17 as illustrated in FIG. 4 of the drawings. The gear racks are of suitable vertical extent to accomplish the desired amount of jacking and engage with rotatable gear means (not shown) in the jack mechanism 50 whereby longitudinal movement of each of the legs 16 may be effected to first position the legs 16 on the bed 35*a* and to thereafter move the hull 30 up the legs 16 to the desired elevation. The various jacking structures and arrangements thereof are well known to those skilled in the art and further details thereof are believed unnecessary to an understanding of the present invention.

Since the jacking guide means 40 and 40*a* of the present invention are not employed to transmit storm loading between the leg 16 and the platform or hull 30 in the jacked up condition, the clearance between the guide surfaces 41*b* of the lower jacking guide means 40*a*, and the corresponding guide surfaces of the upper jacking guide means 40 in relation to the outer surface 17*b* of the vertical leg chord 17 is not critical. Thus, the problems encountered in fabrication with prior art devices is eliminated since such clearance is not critical.

Figure 5:
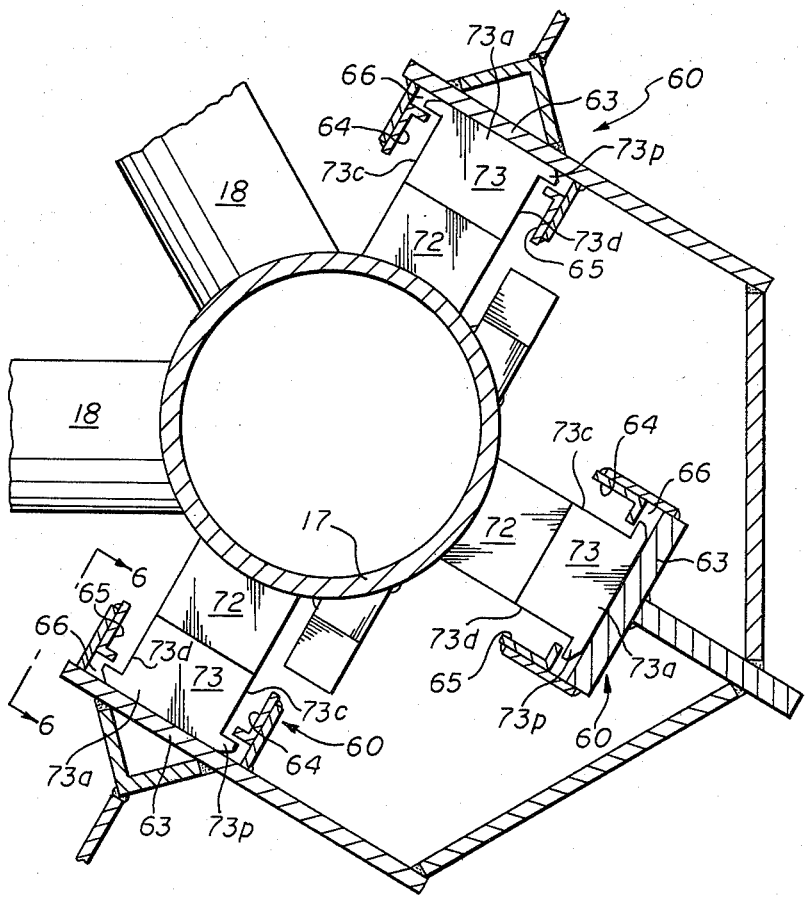
FIG. 5 is a diagrammatic sectional view on the line 5—5 of FIG. 3 and illustrating one arrangement of the wedge guide means and wedge means of one vertical leg chord of a truss leg as illustrated and shown in the drawings.

A plurality of vertically extending wedge guide means 60 is spaced about each vertical member or leg chord 17 of each leg 16. One arrangement is shown in FIG. 5 wherein three of such wedge guide means 60 are employed for each leg chord 17, leg chord 17 represented as being cylindrical in FIG. 5. As there illustrated, two of the wedge guide means 60 may be diametrically opposed in relation to a tubular leg chord 17 with the third guide means 60 being arranged at generally a right angle relative to the diametrically opposed guide means 60 as shown in FIG. 5 of the drawings.

As previously described and noted with regard to the example arrangement depicted in FIG. 4, there are three upper and lower jacking guide means for each vertical chord member 17 of each leg 16. Where this example arrangement is employed with a triangular-shaped truss leg 16, as hereinbefore referred to, each leg 16 will have nine upper jacking guide means 40, three for each of the three vertical chords 17. Similarly, for this example arrangement, there will be nine lower jacking guide means 40*a* for each triangular leg 16, that is three lower jacking guide means for each vertical chord 17.

Similarly, for the triangular-leg example arrangement illustrated in FIG. 5, each vertical chord 17 of each leg 16 is provided with three circumferentially spaced wedge guide means 60. It will also be noted that the wedge guide means 60 are arranged so that there are three upper guide means for each vertical member 17 adjacent the jack housing 30*c* and there are three lower wedge guide means 60 for each vertical member 17 adjacent the lower portion of the hull 30 as shown in FIG. 3. For purposes of description herein, the upper vertically extending wedge guide means will be referred to generally by the numeral 60*a* and the lower vertically extending wedge guide means will be referred to as 60*b*. Where the leg 16 configuration is other than triangular, and where the vertical leg chord 17 is other than cylindrical, a suitable number of wedge guide means other than three, if necessary, will be employed for each leg chord and each leg to accomplish the results of the present invention.

The upper vertically extending guide means 60*a* may extend upwardly from 60*c* adjacent the top of the jack housing 30*c* and may be braced by any suitable means such as the brace 61 extending between jack housing 30*c* and the upper part or end 60*d* of upper guide means 60*a* as shown in FIG. 3. The lower guide means 60*b* are of suitable vertical extent with 60*e* representing the bottom and 60*f* representing the top of lower guide means 60*b*. The upper and lower guide means 60*a*, 60*b* are thus directly connected with the hull 30 whereby loads from leg chords 17 are transmitted through the circumferentially spaced upper and lower pairs of wedge means to the hull 30. The upper wedge guide means 60*a* and lower wedge guide means 60*b* may assume any configuration and, as illustrated, is shown as being generally channel-shaped with a base 63 and spaced, vertically extending, sides 64 and 65 projecting from the vertically extending base plate 63. The minimal vertical extent of each guide means 60*a* and 60*b* is one-half the vertical extent of the bay height on the adjacent leg means plus the vertical extent of the back edge or member 73*a* of rear wedge 73 positioned in the guide means 60.

Figure 10:
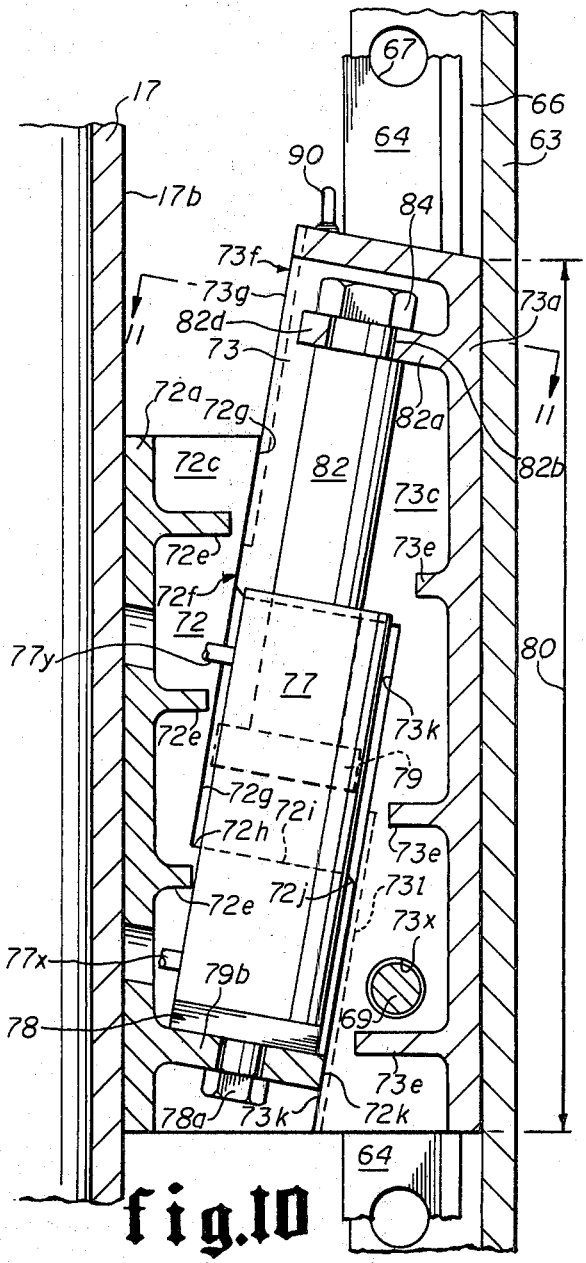
FIG. 10 is a sectional view on the line 10—10 of FIG. 9 and illustrating a different position of the wedges and hydraulic cylinder.

For example, by referring to FIGS. 1A and 3, the bay height of the legs 16 shown in each FIGS. 1A and 3 is represented by the dimension indicated at 75, and the height of the member 73*a* of rear wedge 73 is illustrated in FIG. 10 by the numeral 80. Thus, the vertical extent of each of the three guide means 60*a*, 60*b* arranged around each of the vertical chords 17 of each of the legs 16 is a minimum of one-half the vertical extent represented by the dimension 75 in FIG. 1A plus the dimension represented at 80 in FIG. 10. Thus, the minimum vertical extent of the upper guide means 60*a* is represented by the numeral 63*a* and the minimum vertical extent of the lower guide means 60*b* is represented by the numeral 64*a* in FIG. 3. The purpose of this minimum vertical extent of the guide means 60*a* and 60*b* will be described hereinafter.

The vertically extending sides 64, 65 of each of the guide means 60*a* and 60*b* is constructed so that the width of the guide means back 63 is slightly greater than the width of the wedge back 73*a* of the rear wedge 73. This arrangement is more clearly illustrated in FIG. 5 of the drawings, wherein it will be noted that the sides 64, 65 are formed in any suitable manner so that a vertical groove 66 is provided adjacent the base 63 along each vertical side of each of the wedge guide means 60*a* and 60*b*. The wedge back 73*a* of each rear wedge 73 extends beyond the sides 73*c*, 73*d* to provide a portion 73*p* which extends vertically adjacent each of and laterally of each of the wedge sides 73*c* and 73*d* to be slidably received within the groove 66 adjacent the rear of each of the guide means 60*a* and 60*b*. It will be further noted that the depth of the groove 66 is greater than the width or extent of each of the projections 73*p* so that the rear wedge means 73 can move a limited degree laterally relative to the vertically extending guide means 60*a* and 60*b*.

Figure 6:
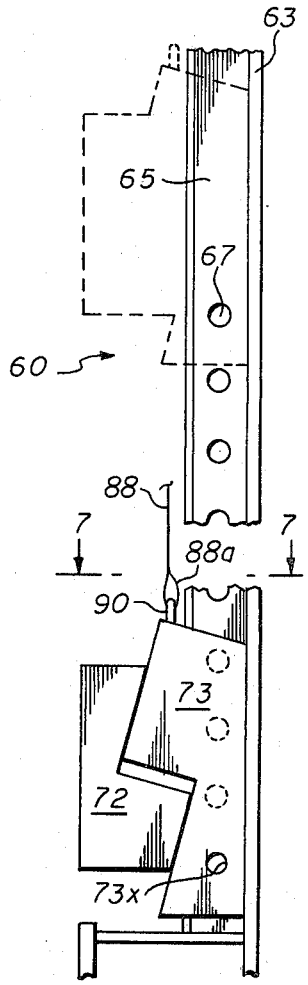
FIG. 6 is a view on the line 6—6 of FIG. 5 illustrating further details of a portion of the wedge guide means.
Figure 7:
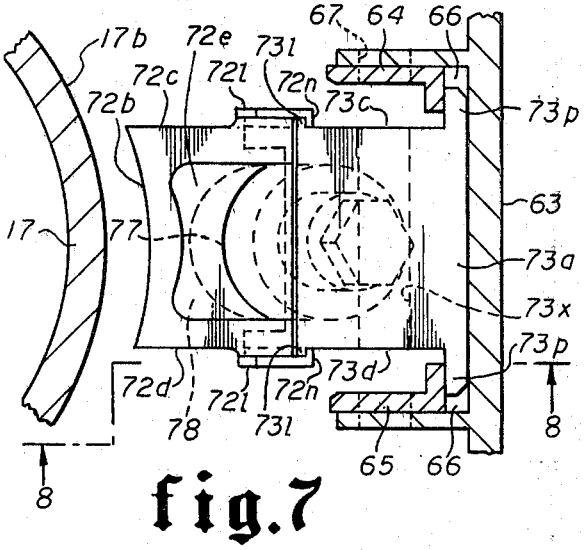
FIG. 7 is a sectional view on the line 7—7 of FIG. 6 to illustrate further details of the wedge means, wedge means and their respective relationship to the leg chord.
Figure 9:
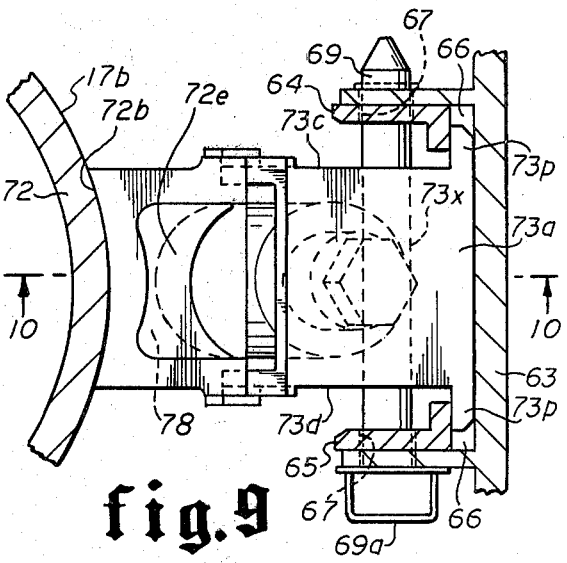
FIG. 9 is a view similar to FIG. 7 but illustrating a locking pin in position in the wedge guide means and wedge means.

The side members 64, 65 of each of the upper guide means 60*a* and the lower guide means 60*b* are provided with openings 67 at vertically spaced intervals therealong as illustrated in FIG. 6 of the drawings. The sides 73*c* and 73*d* of the rear wedge 73 are each provided with an opening 73*x* which may be aligned with any one of the openings 67 in the side members 64, 65 to receive the pin 69 therethrough. This locks the rear wedge 73 at any desired position vertically along either the upper guide means 60*a* or the lower guide means 60*b*.

An upper wedge means referred to generally by the numeral 71*a* is provided for each of the three upper guide means 60*a* and a lower wedge means referred to generally by the numeral 71*b* is provided for each of the lower guide means 60*b* as illustrated in FIG. 3 of the drawings. Each wedge means 71*a* and 71*b* includes a front wedge 72 and a rear wedge 73.

The front wedge 72 includes a vertically extending front member 72*a* which is provided with a surface which is shaped to fit the surface of the leg chord to which it engages. For illustration purposes, it is shown as a curved or arcuate surface 72*b* for engaging the periphery 17*b* of the vertical chord 17. Sides 72*c* and 72*d* extend rearwardly from the front member 72*a* and extend vertically thereof. If desired, suitable bracing may be provided as illustrated at 72*a* at longitudinally spaced intervals between the front member 72*a* and the sides 72*c* and 72*d* to provide a wedge strong enough to transmit the loads it may encounter. The sides 72*c*, 72*d* each have a rear edge referred to generally at 72*f* which forms two parallel sloping surfaces that slideably engage two mating sloping parallel surfaces on the front edge 73*f* of the rear wedge 73 as shown in FIGS. 8 and 10.

Figure 8:
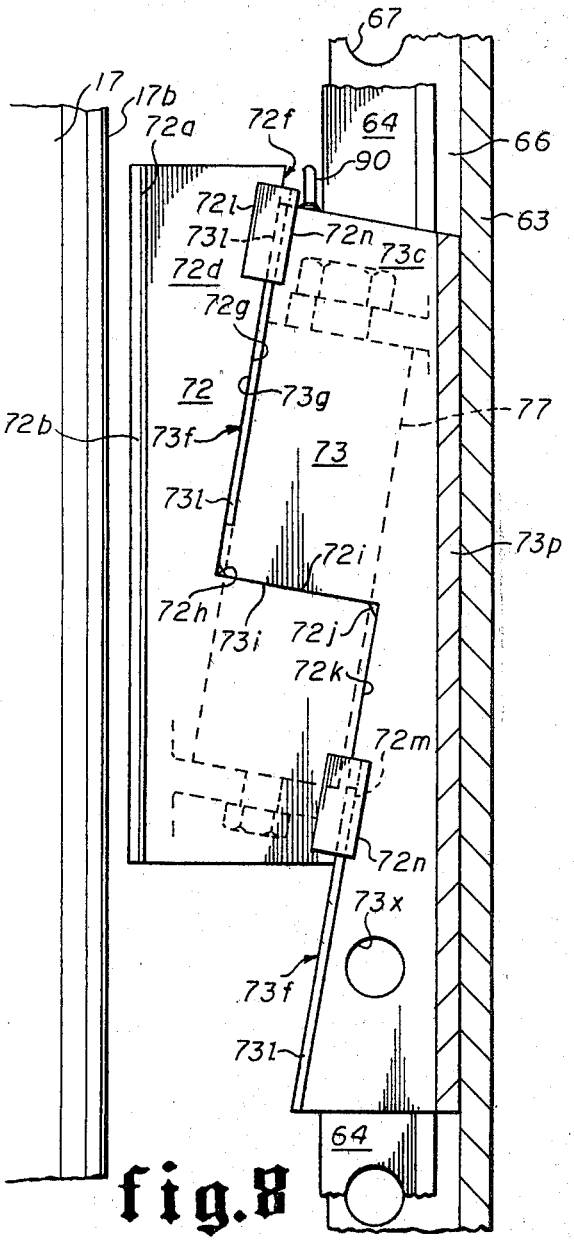
FIG. 8 is a sectional view on the line 8—8 of FIG. 7.

The first sloping edge surface 72*g* on the rear edge of sides 72*c*, 72*d* extends from the upper end of sides 72*c*, 72*d* downwardly and is inclined inwardly towards front member 72*a* as illustrated in FIGS. 8 and 10. The first sloping surface 72*g* terminates intermediate the upper and lower ends of sides 72*c*, 72*d* as indicated at 72*h*, and the edge 72*i* of each side member 72*c*, 72*d* extends rearwardly from the termination 72*h* as shown in FIG. 10. The second parallel sloping edge surface 72*k* begins at the termination 72*j* of edge 72*i* and extends to the lower end of sides 72*c*, 72*d* as illustrated in FIG. 10.

The rear wedge 73 includes a vertically extending member 73*a* to which is connected sides 73*c* and 73*d*. Suitable reinforcing as illustrated at 73*e* may be provided between the members 73*a*, 73*c* and 73*d* to carry the loads involved. Sides 73*c* and 73*d* each have front edges referred to generally at 73*f* which, as previously noted, define two parallel surfaces 73*g* and 73*k* that mate with and slidably engage sloping edge surfaces 72*g* and 72*k* on wedge 72.

The edge 73*i* connects edge surfaces 73*g* and 73*k* in a manner similar to that described with regard to edge 72*i*. Any suitable arrangement may be used to interconnect wedges 72, 73 for relative sliding engagement. As shown, member 721 is secured on each side 72*c*, 72*d* adjacent the upper end thereof as shown in FIG. 8. Also, a member 72*m* is secured to each side 72*c*, 72*d* adjacent the lower end thereof. Each member 72*z* and 72*m* is provided with a vertically extending projection 72*n* that engages projecting lip 731 adjacent sloping edge surfaces 73*g* and 73*k* of wedge 73 so that wedges 72, 73 are interconnected to accommodate relative sliding movement. Edges 72*g*, 73*g* and 72*k*, 73*k* abut to transmit load between the wedges 72, 73.

Figure 11:
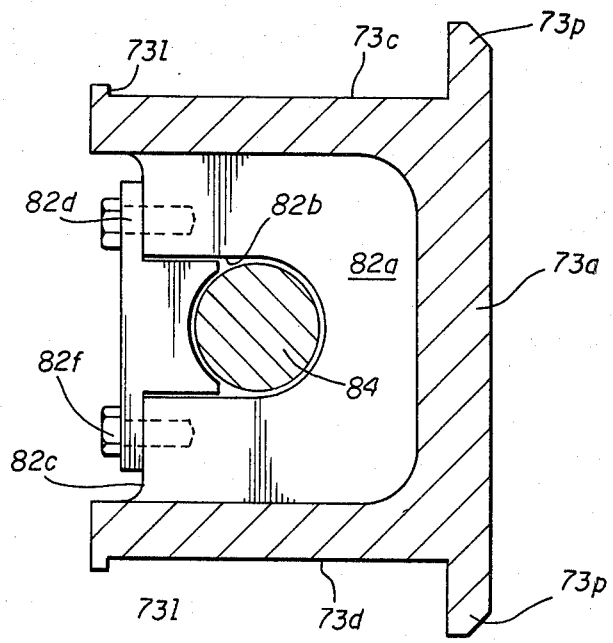
FIG. 11 is a sectional view on the line 11—11 of FIG. 10.

Means are provided to further interconnect the wedges 72 and 73 to effect movement therebetween and control movement therebetween, such means being illustrated as the hydraulic double-acting cylinder 77, having a piston 79 therein, with which is connected a piston rod 82 that extends from the double-acting hydraulic cylinder 77 as shown in the drawing. Rib or member 82*a* is provided with a recess 82*b* extending from edge 82*c* as shown in FIG. 11. The upper end of piston rod 82 is provided with a threaded opening (not shown). Before the cylinder 77 and its piston rod 82 is positioned as shown in the drawings, threaded bolt 84 may be engaged with the threaded hole in the end of the piston rod 82, and after the cylinder and piston rod are positioned on wedges 72, 73 the bolt head is rotated to seat on rib 82*a* as shown. Keeper member 82*d* may then be secured on edge 82*c* by any suitable means such as screws 82*f* to retain keeper member in position on rib 82*a* to secure and retain piston rod 82 on wedge 83. As shown in the drawings, the piston rod is shown as being connected with the rear wedge 73, but the position of the hydraulic cylinder 77 and piston rod 82 could be reversed so that the cylinder 77 is connected with the wedge 73. The double-acting hydraulic cylinder 77 is provided with suitable means including a non-circular mounting plate 78 secured to an end of the cylinder 77 by any suitable means. A bolt 78*a* may be engaged through member 79*b* to hold cylinder 77 on one of the wedges. As illustrated in the drawings, the hydraulic cylinder is shown as being connected to the front wedge 72 and is provided with fluid inlet and outlets 77*x* and 77*y*.

Suitable means are provided to move each of the upper wedge means 71*a*, such means comprising a cable represented at 88 in FIG. 3 which is wound on the winch or drum 89, with one end of the cable as illustrated at 88*a*, being connected to the rear wedge 73 of wedge means 71*a* by any suitable means such as the eye 90 as illustrated in FIG. 10 of the drawings. A similar arrangement is provided for each of the lower wedge means 71*b*. It will be noted that the upper winch means 89 is mounted at the top of the vertically extending guide means 60*a* and the winch means 89*a* for the operation of the cable 88 that is connected to the lower wedge means 71*b* may be mounted on the surface 30*d* of the hull 30 as shown in FIG. 3.

As previously noted and shown in FIG. 4, each vertical member or chord 17 of each leg 16 may be provided with a gear rack 50′ with gear teeth 51′ thereon for engagement with suitable gear means in the jack mechanism 50 to engage with the gear teeth 51′ of the gear rack 50′ as one jacking arrangement to accomplish the initial seating of the legs 16 on the seabed 35*a* and to thereafter effect elevation of the hull 30 along the legs to a desired position above the water as illustrated in FIG. 1A.

From the foregoing description, it can be seen that means are provided in the form of the cable means 88 and the power of hand-operated winch 89 or 89*a* to move each of the wedge means 71 to any desired vertical position along either the upper guide means 60*a* or lower guide means 60*b*, respectively. In addition, the wedges 72 and 73 are interlocked together at their abutting, sliding surfaces 72*g*, 73*g* and 72*k*, 73*k* to accommodate relative movement along these sliding surfaces to effect horizontal movement of the front wedge 72. In addition, the front and rear wedges 72, 73 are interlocked as shown and also by the double-acting hydraulic cylinder 77 and piston rod 82 to secure the front wedge 72 and rear wedge 73 together at any desired horizontal relationship so as to prevent undesired horizontal relative movement therebetween.

Further, the arrangement of the wedge back 73*a* of each rear wedge 73 relative to the vertically extending guide means back 63 of each guide means 60 accommodates limited relative lateral movement between the wedge means 71 formed by the front wedge 72 and rear wedge 73 while also accommodating relative vertical movement along each of the guide means 60 and the wedge means 71 carried thereby.

In operation of the present invention, the legs 16 are retracted when it is desired to move the structure from one position to another to accomplish drilling operations. When the structure is on location in a water-covered area, each of the legs 16 may be lowered onto the seabed 35*a* by operating the jack mechanism 50 so as to lower each of the legs 16 onto the bottom 35*a* in the water-covered area 35. Thereafter, continued operation of the jack mechanism 50 causes the gears (not shown) to cooperate with the gear rack 50′ on each vertical chord 17 of each leg to elevate the hull 30 to final position. It is then desirable to secure the hull 30 to the legs 16 so as to accommodate normal loading encountered during drilling or other operations as well as additional loading which may occur during a storm.

As previously noted, this has heretofore been accomplished merely by trying to maintain as small as possible clearance between the vertical chords 17 and the jacking guides mounted in the structure, while also providing sufficient clearance between the jacking guides and the chords 17 to accommodate relative vertical movement without binding therebetween in an endeavor to position the legs 16 on the seabed properly.

The present arrangement overcomes the difficulties encountered with such prior art arrangement in that the wedges are employed to positively engage and secure the legs 16 to the hull 30 after the hull 30 has been elevated to its final position so that loads may be transmitted from the legs to the hull through the wedge means.

Should the legs 16 assume the position represented in FIG. 1A so that there is a relative difference in vertical position of each leg then the hull 30 must be vertically positioned such that the joints of each leg are adjacent a guide means 60 to enable the wedge means 71*a*, 71*b* to be properly positioned. Cable means 88 and upper and lower winches 89, 89*a* are actuated so as to position upper and lower wedge means 71*a*, 71*b* in alignment with or adjacent a joint of the chord 17 where the horizontal brace 18 and lateral braces 18*a* connect with the vertical chord 17. A pin 69 may be grasped by the handle means 69*a* and then inserted through the openings 67 in the side member 65 of the guide means 60, then through the opening 73*x* in the rear wedge 73 and then through the opening 67 in the side 64 of the guide means 60. This secures the wedge means 71*a*, 71*b* in the guide means 60. In this manner, each upper and lower wedge means 71*a*, 71*b* associated with each upper and lower guide means 60*a*, 60*b* about each chord 17 of each leg 16 may be secured in position.

Thereafter, hydraulic fluid from a source (not shown) may be conducted through suitable hoses (not shown) to the opening 77*x* in each of the double-acting cylinders 77 to effect relative movement along the sliding surfaces between the front wedges 72 and the rear wedges 73, that are secured to the guide means 60, thus causing horizontal movement of front wedges 72 towards leg chords 17 of legs 16. Such movement would continue until the front surface 72*b* engages the periphery 17*b* of the vertical chord 17. During such movement the wedge means 71*a*, 71*b* may require lateral movement to accommodate proper seating of each of the surfaces 72*b* on the periphery 17*b* of each leg chord 17. Suitable hydraulic controls well known to those skilled in the art may be employed to retain the extended position of the front wedge 72 relative to the rear wedge 72 so that each of such front wedges in each of the guide means 60 is firmly locked against the vertical chord or member 17 of each leg 16.

Thus, each chord 17 of each leg 16 is secured to the hull 30 adjacent a joint of each chord 17 by the upper and lower wedge means 71*a*, 71*b* so as to transmit load directly from the legs 16 to the hull 30.

If it should become necessary to operate the jacking mechanism 50 in an emergency situation, such may be accomplished with the present invention. The front wedge 72 is locked in position relative to the rear wedge 73 by the hydraulic cylinder means as previously described so as to prevent it from sliding on the back wedge. Thus, in an emergency situation, if it should be necessary to jack or elevate the platform at one of the legs, the front wedge of the pair or wedges may be held in place on the back wedge 73 by the hydraulic cylinder arrangement so that the front wedge cannot move relative to the rear wedge and tighten against the leg chord 17 further as jacking is effected, which sliding would prevent jacking or could damage the structure. The back wedge 73 is held in vertical position relative to the guide means 60 so that there is not any relative movement between them when jacking in an emergency situation.

The locking of the front wedge 72 in position on the rear wedge 73 also prevents sliding of the front wedge on the back wedge when a horizontal load is applied by any of the leg chords. The foregoing structure enables the present invention to more evenly distribute the loads between the vertical chords of each leg 16 and the hull 30 than was possible with the prior art.

For example, attention is directed to FIG. 2 of the drawings wherein the arrangement 15 of the present invention is again generally referred to with the structure being shown as built to accommodate triangular legs. The location of the wedge guide means and wedge means relative to each leg is schematically represented by the numeral 90' in FIG. 2 and a specific direction of a force that may be applied to the legs is represented by the arrow 91. Since the present invention reduces, if not completely eliminates any clearance at the reaction points between the various legs 16 and the hull 30, the distribution of loads between the chords can be calculated. Since the distribution of reaction forces is thus known, the maximum individual reaction force which must be designed for is considerably less than it is for reaction points in prior art construction where no means is provided to eliminate clearances at reaction points. The design of the leg chords and brace members are both dependent on this force, as is the support structure for the legs in the platform. Also, the reaction force is uniformly applied on surface area **72*b* of the wedge means 71 and surface 17*b* of leg chord 17 as represented by the arrows 92**.

In FIG. 2A, an arrangement is schematically illustrated wherein a square arrangement of the legs 16 is employed. The diagrammatic arrangement of the paired upper and lower wedge means in the upper and lower vertically extending guide means is illustrated by the numeral 90" adjacent each of the leg chords. It will be noted that in the example arrangement shown there are employed a pair of wedge guide means with wedge means adjacent each vertical chord. The two wedge guide means are shown to be at right angles to each other and located as represented at 90", where as in the triangular leg example arrangement three wedge guide means for each leg chord 17 were shown diagrammtically in FIG. 2 and described in detail herein. In FIG. 2A the force applied to the structure is represented by an arrow 91, and it will be noted that the reaction forces are represented by arrows 92 at the legs which react to the force 91, such reaction force at the legs being substantially uniform. It should be noted that when the legs 16 of the present invention are to be jacked vertically with respect to the platform, the front wedge 72 is raised to its highest location with respect to the back wedge 73. In this position, the wedges 72 are not in contact with any of the chords 17 of any of the legs 16 regardless of the position of the leg chord 17 with respect to the jacking guides 40 and **40*a***.

While the invention has been described with regard to a single vertical chord of one leg, it can be appreciated that the same arrangement will be provided for each of the other vertical chords of each leg. Further, the wedges, legs, guide means and the other structures described herein and shown in the drawings relate to a particular drilling rig design. It can be appreciated that the present invention may be employed in any geometric arrangement of an offshore drilling platform.

The foregoing disclosure and description of the invention are illustrative and explanatory thereof, and various changes in the size, shape and materials, as well as in the details of the illustrated construction may be made without departing from the spirit of the invention.

What is claimed is:

1. In a jack-up type mobile offshore structure wherein a hull provides a working area platform with openings therethrough for receiving vertically extending legs and wherein a cooperating jacking arrangement between the hull and legs enables the legs to be lowered onto a subsea surface so that the hull may then be moved on the legs to an elevated position above the water for conducting drilling or other operations, the invention comprising means to secure the structure and legs together, said means including:

a. a plurality of vertically extending guide means carried by the hull and spaced about each of the legs;

b. a first pair of wedges forming first wedge means movable vertically in said guide means;

c. a second pair of wedges forming second wedge means spaced vertically in said guide means relative to said first wedge means, said second wedge means movable vertically in said guide means;

d. means interconnecting said pair of wedges which forms said first and second wedge means wehreby at least one of the wedges of each of said first and second wedge means may be moved to engage a leg and thereby secure the legs to the structure; and e. means to raise and lower said wedge means in said guide means.

2. The structure of claim 1 wherein said interconnecting means is a double-acting hydraulic cylinder having a piston therein and a piston rod projecting therefrom with said cylinder secured to one of the wedges of a pair and the piston rod secured to the other wedge of the same pair.

3. The structure of claim 1 including means to secure the wedges of a pair in a predetermined position on said guide means as the hull is moved to a level position.

4. The structure of claim 1 including means to hold the wedge of the pair of wedges which is nearest the leg, to keep it from sliding on the other wedge when a horizontal load is applied to the wedge means.

5. The structure of claims 1 or 2 wherein the minimum longitudinal extent of said guide means is one-half the vertical extent of a bay on the legs plus the height of a wedge means when the wedges forming the wedge means are in extended position.

6. The structure of claims 1 or 2 wherein:

a. said guide means is provided with vertically spaced holes therein and wherein the wedge nearest said guide means is provided with a passage therethrough; and b. pin means extends through said wedge and guide means to lock the wedge at a selected position in said guide means.

7. The structure of claim 1 wherein said first and second pair of wedges each include a front wedge for engaging the leg of the offshore structure and a rear wedge which engages said vertically extending guide means.

8. The structure of claim 7 wherein said guide means and said rear wedge of each said first and second pair of wedges include cooperating means to accommodate vertical and lateral movement between said rear wedge of each said first and second pair of wedges and said guide means.

9. The structure of claim 8 wherein said cooperating means includes a longitudinally extending channel on said guide means and projection means on said rear wedge of each said first and second pair of wedges which is narrower than the width of the channel on said guide means to accommodate lateral movement between said guide means and rear wedge while maintaining said guide means and rear wedge engaged for relative vertical movement therebetween.

10. The structure of claim 9 including cable means connected to one of said wedges of each pair, and means to raise and lower said cable means and the respective interconnected pair of wedges with which said cable means is connected.

11. The structure of claim 10 wherein a double-acting hydraulic cylinder having a piston therein and a piston rod projecting therefrom interconnects said front and rear wedges to secure the front wedge in position on said rear wedge after the front wedge has engaged the leg.

12. The structure of claim 1 including means to secure the other of said wedges to said guide means as said one wedge is moved to engage the leg of the structure.

13. In a jack-up type mobile offshore structure wherein a hull provides a working area platform with openings therethrough for receiving vertically extending legs and wherein a cooperating jacking arrangement between the hull and legs enables the legs to be lowered onto a subsea surface so that the hull may then be moved on the legs to an elevated position above the water for conducting drilling or other operations, the invention comprising means to secure the structure and legs together, said means including:

a. a plurality of vertically extending guide means carried by the hull and spaced about each of the legs;

b. front and rear wedges slideably interlocked together forming a first wedge means;

c. means engaging said rear wedge of said first wedge means with said guide means for relative vertical and limited lateral movement between;

d. additional front and rear wedges slideably interlocked together forming second wedge means;

e. means engaging said additional rear wedge of said second wedge means with said guide means for relative vertical and limited lateral movement therebetween;

f. means interconnecting said front and rear wedges of said first wedge means to restrain relative movement therebetween after said front wedge has been engaged with a leg of the structure; and g. means interconnecting said additional front and rear wedges of said second wedge means to restrain relative movement therebetween after said additional front wedge has been engaged with a leg of the structure.

14. The structure of claim 13 wherein said interconnecting means is a double-acting hydraulic cylinder having a piston therein and a piston rod projecting therefrom with said cylinder secured to one of the wedges of a pair and the piston rod secured to the other wedge of the same pair.

15. The structure of claim 1 including means to lock and unlock said first and second wedge means relative to said guide means.

16. The structure of claim 1 including means to secure said rear wedge of each said first and second wedge means to said guide means at predetermined vertical positions in said guide means.

17. In a jack-up type mobile offshore structure wherein a hull provides a working area platform with openings therethrough for receiving vertically extending legs and wherein a cooperating jacking arrangement between the hull and legs enables the legs to be lowered onto a subsea surface so that the hull may then be moved on the legs to an elevated position above the water for conducting drilling or other operations, the invention comprising means to secure the structure and legs together, said means including:

a. a plurality of vertically extending and vertically spaced upper and lower guide means carried by the hull and circumferentially spaced about each of the legs;

b. front and rear wedges slideably interlocked together forming a pair of wedge means connected with each said upper and lower guide means for movement vertically thereof; and c. means interconnecting said front and rear wedges to control relative movement between said front and rear wedges.

18. The structure of claim 17 including means to lock said and unlock rear wedges relative to said guide means.

19. The structure of claim 17 including means to move said pair of wedge means along said guide means.

20. The structure of claim 17 including means to accommodate limited relative lateral movement between said pair of wedge means and said guide means.

21. The structure of claim 17 wherein said interconnecting means is a double-acting hydraulic cylinder having a piston therein and a piston rod projecting therefrom with said cylinder secured to one of the wedges of a pair and the piston rod secured to the other wedge of the same pair.

22. The stucture of claim 1 including means interlocking said first pair of wedges, and means interlocking said second pair of wedges to accommodate relative movement.

23. The structure of claim 22 wherein said interlocking means includes a projecting edge on one of said wedges of each said first and second pair of wedges and an overhanging lip on the other of said wedges of each said first and second pair of wedges slideably engaged with said projecting edge.

24. The structure of claims 1 or 15 or 16 or 19 or 20 or 21 or 20 or 21 wherein the minimum longitudinal extent of said guide means is one-half the vertical extent of a bay on the legs plus the height of a wedge means when the wedges forming the wedge means are in extended position.

* * * * *